US011621131B2

(12) United States Patent
Sullivan et al.

(10) Patent No.: US 11,621,131 B2
(45) Date of Patent: Apr. 4, 2023

(54) SWITCHING DEVICE WITH IMPROVED EPOXY HERMETIC SEAL

(71) Applicant: Gigavac, LLC, Carpinteria, CA (US)

(72) Inventors: Daniel Sullivan, Santa Barbara, CA (US); Murray McTigue, Carpinteria, CA (US); David Hatch, Manson, MA (US)

(73) Assignee: Gigavac, LLC, Carpinteria, CA (US)

( * ) Notice: Subject to any disclaimer, the term of this patent is extended or adjusted under 35 U.S.C. 154(b) by 0 days.

(21) Appl. No.: 17/500,696

(22) Filed: Oct. 13, 2021

(65) Prior Publication Data

US 2022/0115191 A1 Apr. 14, 2022

Related U.S. Application Data

(60) Provisional application No. 63/091,774, filed on Oct. 14, 2020.

(51) Int. Cl.
*H01H 9/04* (2006.01)

(52) U.S. Cl.
CPC ..... *H01H 9/04* (2013.01)

(58) Field of Classification Search
CPC ..... H01H 9/04; H01H 1/06; H01H 51/00; H05K 5/06; G01F 15/14
USPC ..... 200/275, 293
See application file for complete search history.

(56) References Cited

U.S. PATENT DOCUMENTS 3,092,762 A 6/1963 Roters et al.
5,132,653 A * 7/1992 Nakatake ..... H01H 51/065 335/78
10,312,043 B2 6/2019 Yu et al.
(Continued)

FOREIGN PATENT DOCUMENTS

DE 112016000161 10/2017
EP 1484781 A2 12/2004
(Continued)

OTHER PUBLICATIONS

Extended European Search Report dated Feb. 22, 2022 for European Patent Application No. 21202699.1, 9 pages.
(Continued)

*Primary Examiner* — Edwin A. Leon
*Assistant Examiner* — Iman Malakooti
(74) *Attorney, Agent, or Firm* — Lee & Hayes, P.C.

(57) ABSTRACT

Electrical switching devices, such contactor and fuse devices, are disclosed that have improved reliability particularly through thermal cycling. One electrical switching device according to the present invention comprises an outer housing and internal operational components within the outer housing. An internal housing in included in that outer housing that surrounds at least some of the internal operational components. A sealing material is also included within the outer housing that is capable of forming a hermetic seal within the outer housing, wherein the sealing material contacts the internal housing. The internal housing has a CTE that substantially matches the CTE of the sealing material. Electrical system according to the present invention comprises an electrical circuit and an improved electrical switching device electrically connected to the electrical circuit to reliably open or close the circuit.

20 Claims, 3 Drawing Sheets

(56) References Cited

U.S. PATENT DOCUMENTS

| | | | | |
|---|---|---|---|---|
| 2009/0039545 | A1* | 2/2009 | Hayase | H01H 50/14 264/261 |
| 2009/0101385 | A1 | 4/2009 | Bush et al. | |
| 2011/0120844 | A1* | 5/2011 | Hoffmann | H01H 50/02 200/275 |

FOREIGN PATENT DOCUMENTS

| | | | |
|---|---|---|---|
| EP | 1548771 | A2 | 6/2005 |
| EP | 2325860 | A1 | 5/2011 |
| WO | WO2008033349 | A2 | 3/2008 |

OTHER PUBLICATIONS

Szymiczek, et al., "Influence of epoxy resin curing systems and aluminium surface modification on selected properties of adhesive joints", Polish Journal of Chemical Technology, vol. 20, No. 4, Dec. 1, 2018, pp. 26-31.

European Office Action dated Feb. 14, 2023, for European patent application No. 21202699.1, a foreign counterpart of U.S. Appl. No. 17/500,696, 8 pages.

* cited by examiner

SWITCHING DEVICE WITH IMPROVED EPOXY HERMETIC SEAL

This application claims the benefit of U.S. Provisional Patent Application Ser. No. 63/091,774, filed on Oct. 14, 2020.

BACKGROUND

Field of the Invention

Described herein are configurations for use with electrical switching devices such as contactor and electrical fuse devices.

Description of the Related Art

Connecting and disconnecting electrical circuits is as old as electrical circuits themselves and is often utilized as a method of switching power to a connected electrical device between "on" and "off" states. An example of one device commonly utilized to connect and disconnect circuits is a contactor, which is electrically connected to one or more devices or power sources. A contactor is configured such that it can interrupt or complete a circuit to control electrical power to and from a device. One type of conventional contactor is a hermetically sealed contactor.

In addition to contactors, which serve the purpose of connecting and disconnecting electrical circuits during normal operation of a device, various additional devices can be employed in order to provide overcurrent protection. These devices can prevent short circuits, overloading, and permanent damage to an electrical system or a connected electrical device. These devices include disconnect devices which can quickly break the circuit in a permanent way such that the circuit will remain broken until the disconnect device is repaired, replaced, or reset. One such type of disconnect device is a fuse device, and a conventional fuse is a type of low resistance conductor that acts as a sacrificial device. Typical fuses comprise a metal wire or strip that melts when too much current flows through it, interrupting the circuit that it connects. Other more complex fuse devices have also been developed, such as those described in U.S. Pat. No. 9,887,055, assigned to Gigavac, Inc., the assignee of the present application which is hereby incorporated by reference.

As society advances, various innovations to electrical systems and electronic devices are becoming increasingly common. An example of such innovations includes recent advances in electrical automobiles, which are becoming the energy-efficient standard and are replacing many traditional petroleum-powered vehicles. In such expensive and routinely used electrical systems, overcurrent protection is particularly necessary to prevent system malfunction and prevent permanent damage to the systems. Furthermore, overcurrent protection can prevent safety hazards, such as electrical fires. These modern improvements to electrical systems and devices require modern solutions for contactors and fuse devices used in the systems to increase performance, reliability, convenience, efficiency and safety of the electrical systems.

As these electrical and electronic systems have become more common, there is a continued effort to develop contactor and fuse devices for these systems that are more reliable under different environmental conditions. One of these environmental conditions is thermal cycles, wherein the electric system and its components can experience different high and low temperatures (e.g. thermal cycles) during operation. It can be important for switching devices to reliably withstand many thermal cycles during their operational lifetime.

SUMMARY

The present invention is directed to switching devices arranged for more reliable operation during thermal cycling. The present invention is particularly applicable to contactor devices, and in some embodiments, different internal elements can be included in the contactor device to help the device maintain its hermetic seal through numerous thermal cycles. These internal elements can comprise a material having a coefficient of thermal expansion (CTE) that is relatively close to that of the contactor device's internal sealing material, and can comprise a material with some flexibility. This allows for the internal elements to flex/move with the sealing material during thermal cycles.

One embodiment of an electrical switching device according to the present invention comprises an outer housing and internal operational components within the outer housing. An internal housing is included in the outer housing that surrounds at least some of the internal operational components. A sealing material is also included within the outer housing that is capable of forming a hermetic seal within the outer housing, wherein the sealing material contacts the internal housing. The internal housing has a CTE that substantially matches the CTE of the sealing material.

One embodiment of an electrical system according to the present invention comprises an electrical circuit and an electrical switching device electrically connected to the electrical circuit to open or close the circuit. The switching device comprises an outer housing and internal operational components within the outer housing. An electrically isolated internal housing is included in the outer housing around at least some of the internal operational components. A sealing material is included within the outer housing, wherein the sealing material contacts the internal housing. Wherein the internal housing has a CTE that substantially the same as the CTE of the sealing material.

These and other further features and advantages of the invention would be apparent to those skilled in the art from the following detailed description, taken together with the accompanying drawings, wherein like numerals designate corresponding parts in the figures, in which:

DETAILED DESCRIPTION

Figure 1:
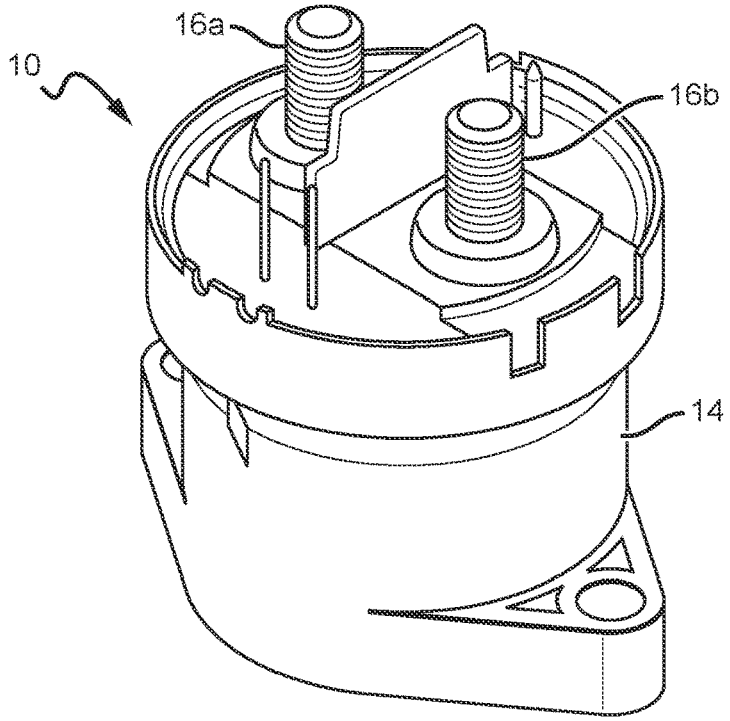
FIG. 1 is a perspective view of one embodiment of a contactor device according to the present invention.
Figure 2:
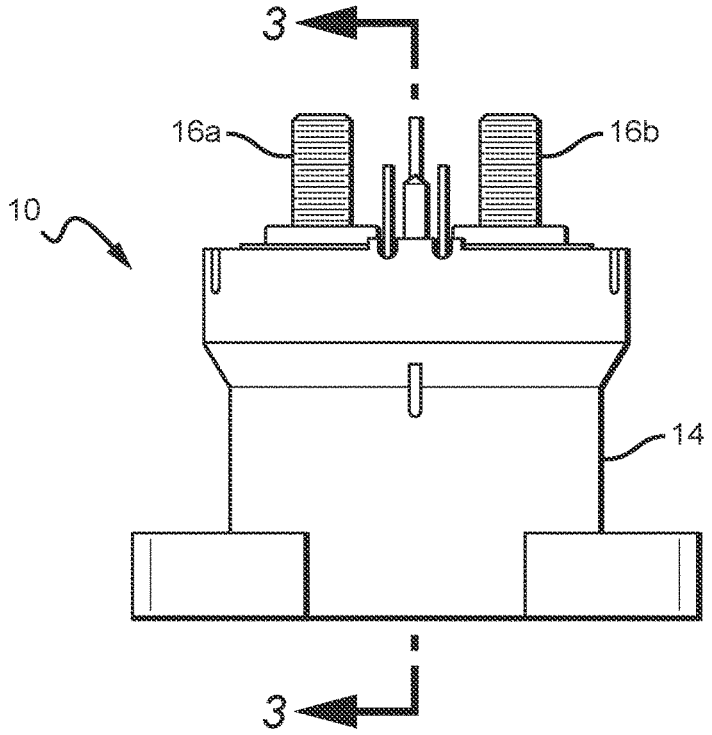
FIG. 2 is a side view of the contactor device shown in FIG. 1.
Figure 4:
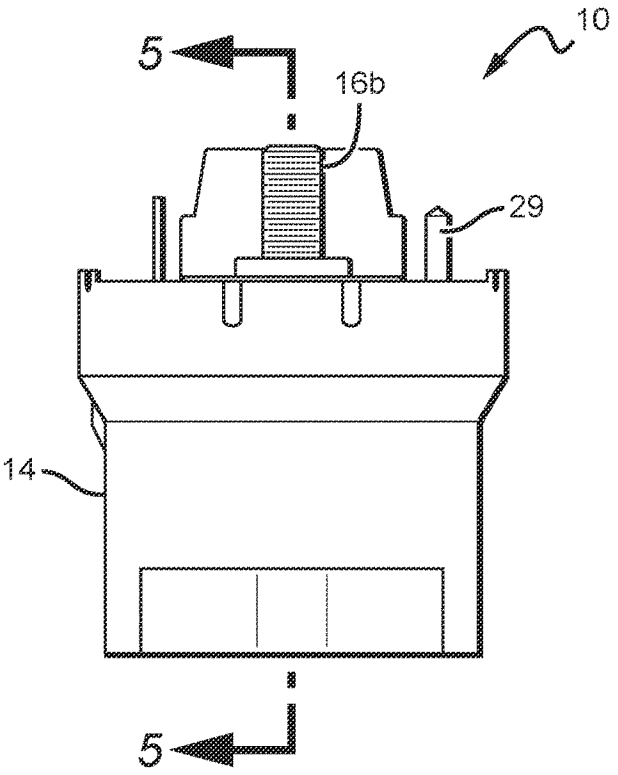
FIG. 4 is another side view of the contactor device shown in FIGS. 1-3.

The present disclosure will now set forth detailed descriptions of certain embodiments of contactor devices according to the present invention. These contactor devices can be electrically connected to an electrical device or system to turn power to the connected device or system "on" or "off."

It is understood that although the present inventions are described with reference to contactor devices, the inventions can also be used in other devices, such as fuse devices.

The present invention is generally directed to providing improved reliability of the contactor devices through repeated thermal cycling. In conventional contactor devices an internal sealing material (e.g. epoxy) can be included to fill certain spaces internal to the contactor device and to provide a hermitic seal with certain internal components. This hermetic seal is generally formed between internal operational components such as the outer core (made of low carbon steel) around the solenoid, the fixed contacts, and the tubulation device.

Some of these internal operational components may have a different CTE compared to the sealing material, and may be relatively inflexible. This can result in the particular internal component not expanding, moving or flexing at the same rate and with the sealing material during thermal cycling. This in turn can degrade the hermetic seal between the sealing material and the internal component and can ultimately result in failure of the seal between the two.

The improved reliability of the embodiments according to the present invention can be provided by improving adhesion between the contactor devices' internal components and its sealing material (e.g. epoxy). This can be accomplished in many different ways, with some embodiments comprising one or more internal components with a CTE closer to the sealing material. This allows for the component and the sealing material to expand and contract at the same or similar rate to help maintain the seal between the two. Other embodiments can also include components having improved flexibility. This allows for the internal components to move or flex with the sealing material, to help maintain the seal between the two. As also described in more detail below, the internal components can comprise surface features or texturing to improve the seal with the sealing material.

In some embodiments, the internal components can comprise additional components not typically found in a conventional contactor device. In some embodiments, an internal housing can be included around at least some of the contactor devices' internal operational components, and in particular the outer core surrounding the solenoid. As mentioned above, in conventional contactor devices, these internal components would be in contact with the sealing material and may not provide the desired adhesion during thermal cycling.

The internal housing can serve as a barrier between the internal components and the sealing material, with the sealing material contacting the internal housing instead of the internal components. The internal housing can provide improved adhesion by having different characteristics such as a CTE closer to the sealing material, relatively good flexibility, and surface treatments (e.g. texturing). These characteristics allow for the internal housing to flex/move with the sealing material during thermal cycles and to maintain adhesion with the sealing material. This in turn allows for the contactor device to reliably maintain its hermetic seal following repeated thermal cycles.

Throughout this description, the preferred embodiment and examples illustrated should be considered as exemplars, rather than as limitations on the present invention. As used herein, the term "invention," "device," "present invention," or "present device" refers to any one of the embodiments of the invention described herein, and any equivalents. Furthermore, reference to various feature(s) of the "invention," "device," "present invention," or "present device" throughout this document does not mean that all claimed embodiments or methods must include the referenced feature(s).

It is also understood that when an element or feature is referred to as being "on" or "adjacent" to another element or feature, it can be directly on or adjacent to the other element or feature or intervening elements or features may also be present. It is also understood that when an element is referred to as being "connected" or "coupled" to another element, it can be directly connected or coupled to the other element or intervening elements may be present. Relative terms, such as "inner" and "outer," and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, elements, and/or components, but do not preclude the presence or addition of one or more other features, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein, but are to include deviations in shapes that result, for example, from manufacturing.

FIGS. 1-5 show one embodiment of a contactor device 10 according to the present invention with the contactor device 10 in an "open" circuit position, wherein flow of electricity does not flow through the contactor device 10 as described in more detail below. The contactor device 10 can also be controlled to operate in a "closed" circuit position, where current can flow through the contactor device 10.

The contactor device 10 comprises an outer body or housing 14 ("outer housing"), and two fixed contact structures 16*a*, 16*b* which are configured to electrically connect the internal operational components 17 of the contactor device to external circuitry, for example, to an electrical system or device. The internal operational components 17 include the components that operate to move a movable contact in and out of contact with the fixed contacts 16*a*, 16*b*. These can include, but are not limited to, a solenoid, shaft, spring, movable contact, etc.

The outer housing 14 can comprise any suitable material that can support the structure and function of the contactor device 10 as disclosed herein. A preferred material is a sturdy material that can provide structural support to the contactor device 10 without interfering with the electrical flow through the fixed contacts 16*a*, 6*b* and the internal operational components 17 of the device. In some embodiments, the outer housing 14 can comprise a durable plastic or polymer. The outer housing at least partially surrounds the various internal operational components 17 of the contactor device 1, which are described in more detail further herein.

The outer housing 14 can comprise any shape suitable for housing the various internal operational components 17 including a cylindrical shape, or any regular or irregular polygon shape. The outer housing 14 can be a continuous structure, or can comprise multiple component parts joined. In some embodiments, the outer housing can comprise a base body "cup," and a top "header" portion sealed to the base cup with an adhesive such as an epoxy material. Some example body configurations include those set forth in U.S. Pat. Nos. 7,321,281, 7,944,333, 8,446,240 and 9,013,254, all of which are assigned to Gigavac, Inc., the assignee of the present application, and all of which are hereby incorporated in their entirety by reference.

The fixed contacts 16*a*, 16*b* are configured such that the various internal operational components 17 of the contactor device 10 that are housed within the outer housing 14 can be electrically coupled with an external electrical system by the fixed contacts 16*a*, 16*b*. This allows the contactor device 10 to function as a switch to break or complete an electrical circuit as described herein.

The fixed contacts 16*a*, 16*b* can comprise any suitable conductive material for providing electrical contact to the internal operational components 17 of the contactor device 10. In some embodiments, the fixed contacts 16*a*, 16*b* can comprise various metals and metallic materials, or any rigid electrically conductive contact material or structure that is known in the art. The fixed contacts 16*a*, 16*b* can comprise single continuous contact structures (as shown) or can comprise multiple electrically connected structures joined together. For example, in some embodiments, the fixed contacts 16*a*, 16*b* can comprise two portions, a first portion extending from the body 14, which is electrically connected to a second portion internal to the body 4 that is configured to interact with other components internally held in the outer housing 14 as described herein.

In some embodiments, the outer housing 14 can comprise a material having low or substantially no permeability to a gas injected into the housing. In some embodiments, the outer housing 14 can comprise various internal gasses, liquids or solids configured to increase performance of the device. The outer housing 14 can be configured such that the internal space of the outer housing 14, which houses the various internal operational components 17 of the contactor device 10, is hermetically sealed. In some embodiments, the internal areas of the contactor device 10 can be in a vacuum or can have an internal gas (e.g. electronegative gas such sulfur hexafluoride or mixture of nitrogen and sulfur hexafluoride). The hermetically sealed configuration of the outer housing 14 can hold this vacuum or gas, which can help mitigate or prevent electrical arcing between adjacent conductive elements, and in some embodiments, helps provide electrical isolation between spatially separated contacts. The body 14 can be hermetically sealed utilizing any known means of generating hermetically sealed electrical devices. Some examples of hermetically sealed devices include those set forth in U.S. Pat. Nos. 7,321,281, 7,944,333, 8,446,240 and 9,013,254, incorporated into the present application as mentioned above.

When not interacting with any of the other components internal to the body 14, the fixed contacts 16*a*, 16*b* are otherwise electrically isolated from one another such that electricity cannot freely flow between them. The fixed contacts 16*a*, 16*b* can be electrically isolated from one another through any known structure or method of electrical isolation.

Figure 3:
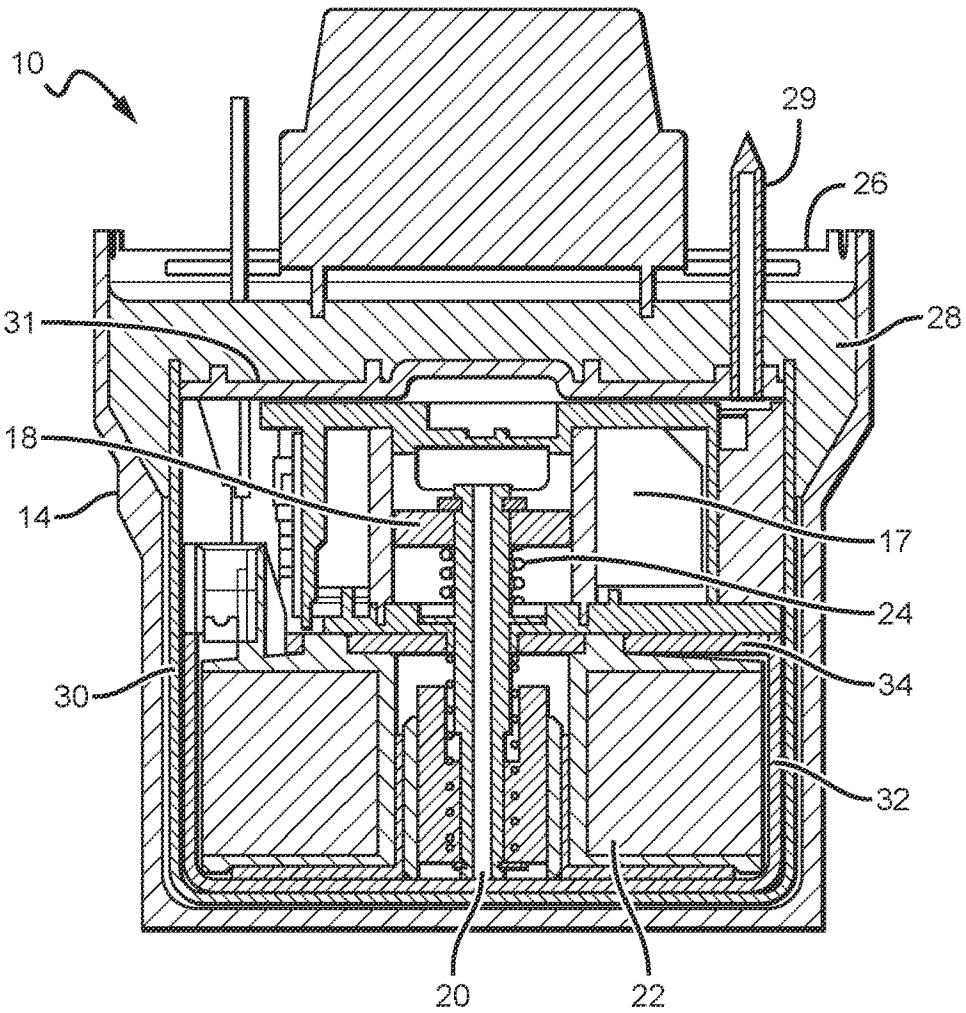
FIG. 3 is a sectional view the contactor device shown in FIGS. 1 and 2, taken along section lines 3-3 of FIG. 2.
Figure 5:
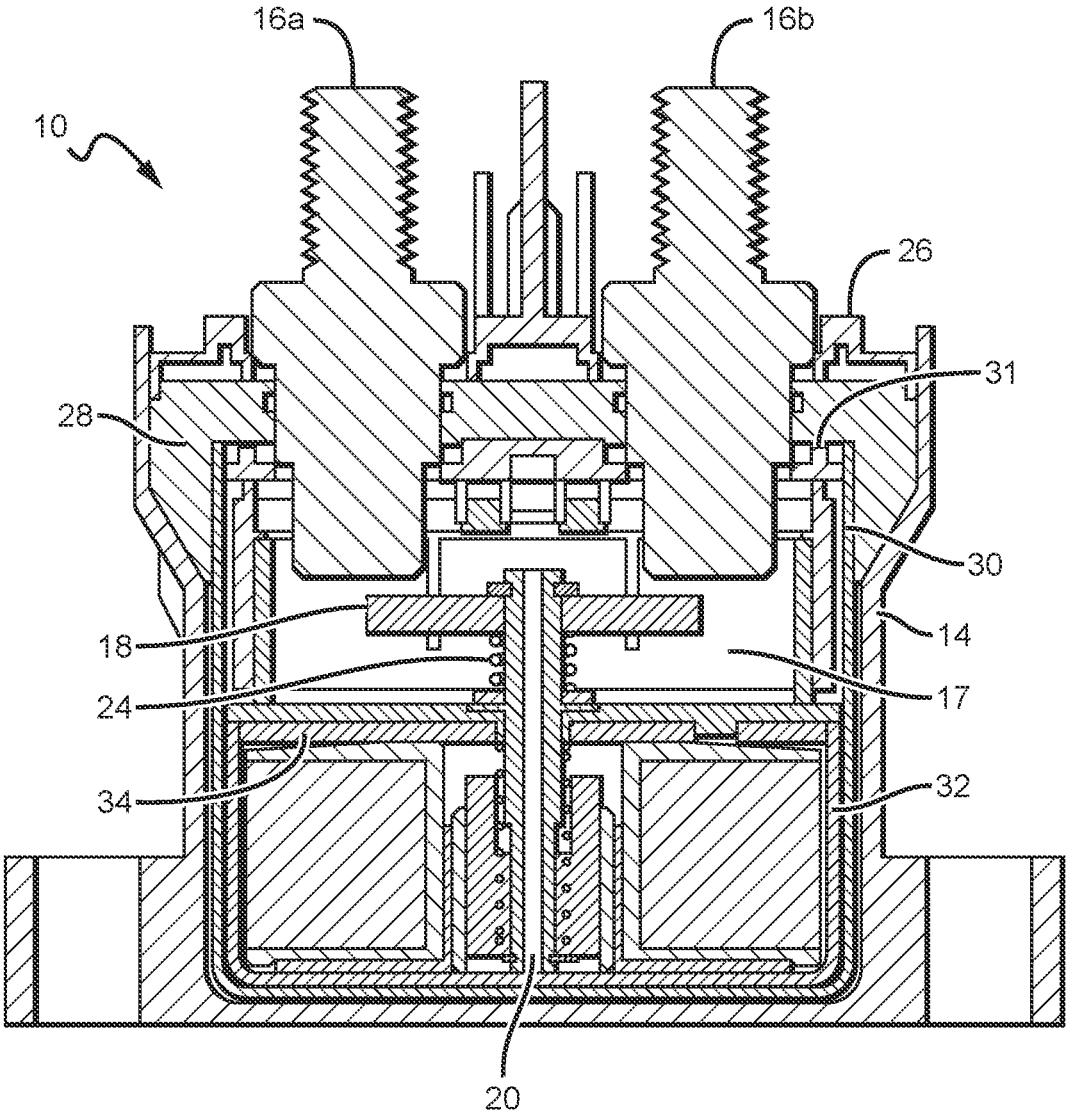
FIG. 5 is a sectional view of the contactor device shown FIGS. 1-4 taken along section lines 5-5 of FIG. 4.

The contactor device 10 also includes an internal movable contact 18. When the contactor device 10 is in its "open" position, as best shown in FIGS. 3 and 5, both of the otherwise electrically isolated fixed contacts 16*a*, 16*b* are not contacted by a moveable contact 18, such that current does not flow through the device 10. When the movable contact 18 moves up to and in contact the fixed contacts 16*a*, 16*b*, the moveable contact 18 functions as an electrically conductive bridge between the otherwise electrically isolated fixed contacts 16*a*, 16*b*. With the movable contact 18 in this position, an electrical signal to flow through the device 10. For example, the electrical signal can flow from the first fixed contact 16*a*, through the moveable contact 18, to the second contact 16*b* or vice versa. Therefore, the contactor device 10 can be connected to an electrical circuit, system or device and complete a circuit while the moveable contact 18 is in electrical contact with the fixed contacts 16*a*, 16*b*.

The moveable contact 18 can comprise any suitable conductive material including any of the materials discussed herein in regard to the fixed contacts 16*a*, 16*b*. Like with the fixed contacts 16*a*, 16*b*, the moveable contact 18 can comprise a single continuous structure (as shown), or can comprise multiple component parts electrically connected to one another so as to serve as a contact bridge between the otherwise electrically isolated fixed contacts 16*a*, 16*b*, so that electricity can flow through the contactor device 10.

The moveable contact 18 can be configured such that it can move into and out of electrical contact with the fixed contacts 16*a*, 16*b*. This causes the circuit to be "closed" or completed when the moveable contact is in electrical contact with the fixed contacts 16*a*, 16*b*, and to be "open" or broken when the moveable contact 18 is not in electrical contact with the fixed contacts 16*a*, 16*b*. In some embodiments, the moveable contact 18 can be physically connected to a shaft structure 20, which is configured to move along a predetermined distance within the contactor device 10. The shaft 20 can comprise any material or shape suitable for its function as an internal moveable component that is physically connected to the moveable contact 18 so that the moveable contact 18 can move with the shaft 20.

Movement of the shaft 20 controls movement of the moveable contact 18, which in turn controls the position of the moveable contact 18 in relation to the fixed contacts 16*a*, 16*b*. This in turn controls flow of electricity through the contactor device 10 as described herein. Movement of the shaft can be controlled through various configurations, including, but not limited to, electrical and electronic, magnetic and solenoid, and manual. Examples of manual configurations for controlling a shaft connected to a moveable contact are set forth in U.S. Pat. No. 9,013,254, to Gigavac, Inc., incorporated into the present application as mentioned above. Some of these example configurations of manual control features include magnetic configurations, diaphragm configurations and bellowed configurations.

For contactor device 10, movement of the shaft 20 is controlled with a solenoid 22. The solenoid 22 is also internal to housing 14 and operates on the drive shaft 20 to move the movable contact 18. Many different solenoids can be used, with one example of a suitable solenoid being a solenoid operating under a low voltage and with a relatively high force. One example of a suitable solenoid is commercially available solenoid Model No. SD1564 N1200, from Bicron Inc., although many other solenoids can be used. In the embodiment shown, the drive shaft 20 can comprise a metallic material that can be moved and controlled by the solenoid 22. The device 10 can also have an internal spring 24 that biases the movable contact 18 to the desired position when the solenoid 22 is not acting on the drive shaft 20.

Contactor devices are typically provided with a magnetic circuit around the solenoid 22. This can include many different materials such as steel or low carbon steel. This magnetic circuit surrounds the solenoid 22 and can comprise an outer core that surrounds the bottom and side surfaces of the solenoid, and a top core that covers the top of the solenoid and the opening of the outer core.

As best shown in FIGS. 3 and 5, the contactor device 10 comprises a header 26 that closes the top opening of the body 14 and encloses the internal operational components 17. The header 26 can be made of many different materials, with some embodiments having a header made of ceramic.

To help hermitically seal the internal operational components 17 of the contactor device 10, a sealing material 28 can be included in the housing 14 in the spaces formed between the housing 14, the header 26, and the internal operational components 17 of the contactor device 10. Many different sealing materials can be used, with some embodiments using an epoxy. In the embodiment shown, the sealing material 28 provides a seal between the fixed contacts 16*a*, 16*b*, the tubulation 29, and the internal housing as described below.

For conventional contactor devices as described above, the sealing material contacts and is intended to make a seal with certain internal operational components 17, such as the outer core that surrounds the solenoid. However, the material that forms the outer cores can be relatively inflexible and can have a coefficient of thermal expansion (CTE) that is substantially different from the sealing material 28. This can result in the outer core and the sealing material experiencing different rates and amount of expansion and contraction during thermal cycling. This can degrade the adhesion between the sealing material 28 and the inner and outer cores during thermal cycles. This can negatively impact the reliability of the contactor device 10 and can ultimately result in failure of the hermetic seal of the device 10. This CTE mismatch can also occur between the sealing material and other internal operation components.

In the contactor devices according to the present invention, an additional internal "housing" or "can" 30 is included that provides improved adhesion with the sealing material to provide improved reliability for contactor device 10 during thermal cycling. This internal housing 30 is not involved in the operation of the contactor device 10, and is considered separate from the internal operational components 17. In some embodiments, the internal housing is electrically isolated from the internal operation components 17, and is included primarily to provide and improved seal with the sealing material as described below. In some embodiments, an internal housing cap 31 can be included over the opening to the internal housing 30.

As best shown in FIGS. 3 and 5, an internal housing 30 and cap 31 can be arranged to surround certain internal operational components 17 of the contactor device 10. In the embodiment shown, the internal housing 30 is cup shaped and the movable contact 18, shaft 20, solenoid 22, spring 24, and the lower portion of the fixed contact 16*a*, 16*b*, are within the internal housing 30. The internal components also include the magnetic circuit mentioned above, that comprises the outer core 32 and top core 34 that surrounds the solenoid. The top core can be sized so that it is nested within the top surface of the outer core 32, or sized so that that it is on the top surface of the outer core. In either case, the appropriate bonding is provided between the top core 34 and outer core 32.

As mentioned above, the outer and top core 32, can comprise different materials such as low carbon steel. The internal housing 30 surrounds these components so that the sealing material 28 contacts primarily the internal housing 30. It is understood that the some of the internal components, such as the outer and inner core 32, 14, and solenoid 22, may be resized (e.g. narrowed or shortened) to be able to nest in the internal housing 30.

The internal housing 30 can comprise many different materials, but preferably comprises a material that is rigid enough to reliably hold the internal operational components 17 of the contactor device 10, but has a CTE closer to that of the epoxy sealing material 28, compared to other internal operational components 17 (such as the outer and inner cores 32, 34). In some embodiments, the CTE of the internal housing can vary within 10% of the sealing material's CTE. In other embodiments, it can vary within 20% or 30%, while still other embodiments can vary within 40%. It is understood that other embodiments can have different percentage variances between the internal housing and sealing material.

The internal housing should also be relatively flexible and able to flex/move with the epoxy sealing material 28 during thermal cycles. In some embodiments the internal housing 30 can comprise a metal or combinations of metals, with one suitable metal being aluminum (Al). The flexibility of the internal housing can be measured in terms of flexural rigidity, and in some embodiments the flexural rigidity of the internal housing is less than others of the internal operational components 17 such as the inner and outer cores 32, 34. In some embodiment the flexural rigidity of the internal housing can be at least 10% less than the inner and outer cores, while in other embodiments it can be at least 20% less or 30% less. In other embodiments it can be at least 40% less than the inner or outer cores. These are only some examples of the differences between the flexural rigidity of the inner housing and the other internal components of the contactor 10.

By having the sealing material 28 contact the internal housing 30, the contactor device can more reliably withstand multiple thermal cycles. Adhesion is more reliably maintained between the internal housing 30 and the sealing material to more reliably maintain the hermitic seal of the contactor device 10.

It is understood that the internal housing 30 can include features to further enhance adhesion surface of internal housing 30 and the sealing material 28. These can include certain surface features where the sealing material contacts the inner housing 30, with some surface features including surface texturing or roughening. In some embodiments, the surface texturing or roughening can be random, while in other embodiments it can be patterned. In still other embodiments, the surface of the inner housing can have surface features such cut-outs or notches, while other embodiments can have surface features such as tabs or other surface projections. These surface texturing and features modify the surface of the inner housing 30 such that a stronger bond is formed with the sealing material. Many different methods can be used for forming the texturing or features, with some embodiments having texturing formed by plasma etching, sand blasting, sanding or anodizing.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. For example, the inner component is described above as an inner housing with a cup shape. It is understood that other embodiments of inner components can comprise different shapes and can be in different locations.

Some embodiments can comprise structures made of more than one component. For example, some embodiments can comprise one or more cylinder shaped devices that can be open at the top and bottom. Therefore, the spirit and scope of the invention should not be limited to the versions described above.

The foregoing is intended to cover all modifications and alternative constructions falling within the spirit and scope of the invention, wherein no portion of the disclosure is intended, expressly or implicitly, to be dedicated to the public domain if not set forth in any claims.

We claim:

1. An electrical switching device, comprising:

an outer housing;

internal operational components within said outer housing, the internal operational components including a solenoid;

an internal housing in said outer housing surrounding at least some of said internal operational components including the solenoid;

an outer core and a top core disposed in the internal housing, the outer core and the top core surrounding the solenoid and forming a magnetic circuit; and a sealing material within said outer housing and capable of forming a hermetic seal within said outer housing, wherein said sealing material contacts said internal housing, and wherein said internal housing has a coefficient of thermal expansion (CTE) that substantially matches the CTE of said sealing material.

2. The electrical switching device of claim 1, wherein the CTE of said internal housing varies less than 40% from the CTE of said sealing material.

3. The electrical switching device of claim 1, wherein the CTE of said internal housing varies less than 20% from the CTE of said sealing material.

4. The electrical switching device of claim 1, comprising a contactor device.

5. The electrical switching device of claim 1, comprising a fuse device.

6. The electrical switching device of claim 1, wherein said internal housing is electrically isolated from said internal operational components.

7. The electrical switching device of claim 1, wherein said internal housing comprises a barrier between said sealing material and said internal operational components.

8. The electrical switching device of claim 1, wherein said internal housing comprises a flexural rigidity less than at least some of said internal operational components.

9. The electrical switching device of claim 1, wherein said internal housing comprises surface roughening or texturing at said surface contacting said sealing material.

10. The electrical switching device of claim 1, wherein said internal housing comprises surface features at said surface contacting said sealing material.

11. An electrical system, comprising:

an electrical circuit;

an electrical switching device electrically connected to said electrical circuit to open or close said circuit, wherein said switching device comprises:

an outer housing;

internal operational components within said outer housing, the internal operational components including a solenoid;

an internal housing in said outer housing surrounding at least some of said internal operational components including the solenoid;

an outer core and a top core disposed in the internal housing, the outer core and the top core surrounding the solenoid and forming a magnetic circuit; and a sealing material within said outer housing and capable of forming a hermetic seal within said outer housing, wherein said sealing material contacts said internal housing, and wherein said internal housing has a coefficient of thermal expansion (CTE) that substantially matches the CTE of said sealing material.

12. The electrical system of claim 11, wherein the CTE of said internal housing varies less than 40% from the CTE of said sealing material.

13. The electrical system of claim 11, wherein the CTE of said internal housing varies less than 20% from the CTE of said sealing material.

14. The electrical system of claim 11, comprising a contactor device.

15. The electrical system of claim 11, comprising a fuse device.

16. The electrical system of claim 11, wherein said internal housing is electrically isolated from said internal operational components.

17. The electrical system of claim 11, wherein said internal housing comprises a flexural rigidity less than at least some of said internal operational components.

18. The electrical system of claim 11, wherein said internal housing comprises surface roughening or texturing at said surface contacting said sealing material.

19. The electrical system of claim 11, wherein said internal housing comprises surface features at said surface contacting said sealing material.

20. An electrical switching device, comprising:

an outer housing;

internal operational components within said outer housing, the internal operational components including a solenoid;

a cup shaped internal housing in said outer housing with at least some of said internal operational components arranged within said internal housing including the solenoid;

an outer core and a top core disposed in the internal housing, the outer core and the top core surrounding the solenoid and forming a magnetic circuit; and a sealing material within said outer housing and capable of forming a hermetic seal within said outer housing, wherein said sealing material contacts said internal housing, and wherein said internal housing has a coefficient of thermal expansion (CTE) that is substantially the same as the CTE of said sealing material.

* * * * *